US010276335B2

(12) United States Patent
Fasano

(10) Patent No.: US 10,276,335 B2
(45) Date of Patent: Apr. 30, 2019

(54) HIGH VOLTAGE DC RELAY

(71) Applicant: Michael Fasano, Watertown, CT (US)

(72) Inventor: Michael Fasano, Watertown, CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days.

(21) Appl. No.: 15/870,473

(22) Filed: Jan. 12, 2018

(65) Prior Publication Data

US 2018/0218864 A1 Aug. 2, 2018

Related U.S. Application Data

(60) Provisional application No. 62/451,442, filed on Jan. 27, 2017.

(51) Int. Cl.
*H01H 51/08* (2006.01)
*H01H 50/04* (2006.01)
(Continued)

(52) U.S. Cl.
CPC ..... *H01H 51/08* (2013.01); *H01H 50/041* (2013.01); *H01H 50/56* (2013.01); *H01H 50/64* (2013.01); *H01H 51/10* (2013.01); *H01H 51/14* (2013.01); *H01H 51/29* (2013.01); *H01H 5/08* (2013.01); *H01H 9/34* (2013.01); *H01H 33/596* (2013.01); *H01H 47/226* (2013.01); *H01H 50/20* (2013.01); *H01H 50/643* (2013.01); *H01H 50/68* (2013.01); *H01H 51/12* (2013.01);
(Continued)

(58) Field of Classification Search
CPC ..... H01H 51/08; H01H 51/10; H01H 51/14; H01H 51/29; H01H 51/27; H01H 51/20; H01H 3/16; H01H 13/18; H01H 33/596; H01R 13/7038
USPC ..... 218/157, 28, 32, 4, 6, 7; 200/16 B, 18, 200/518, 47, 51.03, 51.04
See application file for complete search history.

(56) References Cited

U.S. PATENT DOCUMENTS 982,346 A 1/1911 Brown
1,916,942 A 7/1933 Wright
(Continued)

FOREIGN PATENT DOCUMENTS

DE 607862 C 1/1935

OTHER PUBLICATIONS

Translation of DE607862 (original doc. published Jan. 9, 1935).*

*Primary Examiner* — Edwin A. Leon
*Assistant Examiner* — William A Bolton
(74) *Attorney, Agent, or Firm* — Forge IP, PLLC

(57) ABSTRACT

A latching relay includes a first coil, a second coil and a common plunger operatively connected between the first and second coils such that activation of the first coil moves the plunger to a first position and activation of the second coil moves the plunger to a second position. The latching relay also includes a limit switch having a common contact and first and second coil contacts. A position of the common contact is alternately switched between electrical connection to either the first or second coil contact based on a position of the plunger. The first and second coil contacts are electrically connected to the first and second coils, respectively such that when electrical power is applied to the common contact, the electrical power is alternately applied to either the first coil or the second coil depending on the position of the common contact.

19 Claims, 2 Drawing Sheets

(51) Int. Cl.

| | |
|---|---|
| ***H01H 50/56*** | (2006.01) |
| ***H01H 50/64*** | (2006.01) |
| ***H01H 51/10*** | (2006.01) |
| ***H01H 51/29*** | (2006.01) |
| ***H01H 51/14*** | (2006.01) |
| ***H01H 50/02*** | (2006.01) |
| ***H01H 51/22*** | (2006.01) |
| ***H01H 5/08*** | (2006.01) |
| ***H01H 9/34*** | (2006.01) |
| ***H01H 33/59*** | (2006.01) |
| ***H01H 47/22*** | (2006.01) |
| ***H01H 50/20*** | (2006.01) |
| ***H01H 50/68*** | (2006.01) |
| ***H01H 51/12*** | (2006.01) |

(52) U.S. Cl.
CPC ..... *H01H 2050/025* (2013.01); *H01H 2051/2218* (2013.01)

(56) References Cited

U.S. PATENT DOCUMENTS

| | | | | | |
|---|---|---|---|---|---|
| 2,530,194 | A | * | 11/1950 | Ferry | H01H 51/08 335/196 |
| 2,878,338 | A | * | 3/1959 | Gribble | H01H 51/20 335/261 |
| 3,201,544 | A | * | 8/1965 | Diamant | H01H 51/10 335/120 |
| 3,566,320 | A | * | 2/1971 | Bakes | H01H 71/345 335/174 |
| 5,072,328 | A | * | 12/1991 | Dvorak | H01H 47/24 361/210 |
| 2014/0062623 | A1 | | 3/2014 | Fasano | |

* cited by examiner

HIGH VOLTAGE DC RELAY

FIELD OF THE INVENTION

The invention relates to a latching relay used for high voltage applications, and more specifically, the invention relates to a latching relay that includes high voltage circuit interrupting capacity.

BACKGROUND OF THE INVENTION

Relays have been used in various applications for many years. A relay is a remotely operated switching device that typically includes a coil and at least one set of contacts providing switched power to a connected device. Based on the power applied to the coil, the contacts change state to turn power on/off to the connected device. When power is applied to the coil, the contacts move to an activated state (this could be opened or closed), and when power is removed from the coil, the contacts move to the default state (this again, could be opened or closed).

A latching relay is a particular type of relay that is also known for use in various applications. Latching relays function differently than a "standard" relay described above in that once the relay changes state, the contacts remain in the last position even when power is removed. So, for example, if power is applied to the coil, the contacts will change state (whether opening or closing). When power is removed from the coil, rather than changing back to a default state, the latching relay will remain in the last state. Only by the application of power to change the state of the contacts again, will the latching relay operate.

Known latching relays typically include a permanent magnet in conjunction with a coil. In order to change the state of the contacts in the latching relay, it is required to change the polarity of the power applied to the coil to offset the flux generated by the permanent magnet. These types of known latching relays are also typically biased by a spring.

One of the problems with standard latching relays is the ability for limited application in high voltage applications. High voltage applications typically are associated with high power transfer and therefore, the switching devices used in these applications must be able to effectively and safely switch even under load. The structure described above (permanent magnet used with a coil) provides limited high voltage interrupting capacity.

SUMMARY OF THE INVENTION

The present invention provides for a latching relay that may be used in high voltage applications and allow for switching even under load. In other words, it provides for high current interrupting capacity. For purposes of this application, the term "high voltage" is applied to applications in which is used a voltage higher than that used for power distribution. The lower limit is usually taken as 8,700V according to the National Electrical Safety Code (NFPA 70). However, it should be understood that these voltages do not form any part of the claimed invention and should not be construed as limiting in any way.

In accordance with one embodiment of the present invention, a latching relay includes a first coil, a second coil and a common plunger operatively connected between the first coil and the second coil such that activation of the first coil moves the plunger in a first direction to a first position and activation of the second coil moves the plunger in a second direction, opposite to the first direction, to a second position.

The latching relay also includes a limit switch having a common contact, a first coil contact and a second coil contact. A position of the common contact is alternately switched between electrical connection to either the first coil contact or the second coil contact based on a position of the plunger. The first coil contact is electrically connected to the first coil and the second coil contact is electrically connected to the second coil such that when electrical power is applied to the common contact, the electrical power is alternately applied to either the first coil or the second coil depending on the position of the common contact.

The latching relay may further include a pair of load contacts moveable between a closed position in which power is supplied to a load and an open position in which power to the load is interrupted. In certain of these embodiments, the load contacts are in the closed position when the plunger is in its first position and the load contacts are in the open position when the plunger is in its second position. In some of these embodiments, the pair of load contacts comprises a stationary load contact and a moveable load contact.

In some embodiments, the latching relay further includes a moveable load contact arm operatively connected to the plunger, and the moveable load contact is disposed on the moveable load contact arm. In certain of these embodiments, the latching relay further includes a linkage operatively connected between the plunger, the moveable load contact arm and the limit switch, wherein movement of the plunger causes simultaneous movement of both the moveable contact arm and the common contact of the limit switch via the linkage.

In some embodiments, the latching relay further includes an arc extinguisher positioned adjacent the pair of load contacts, the arc extinguisher adapted to facilitate quenching of an arc created between the pair of load contacts. In certain of these embodiments, the arc extinguisher comprises a plurality of arc quenching plates.

In some embodiments, the latching relay further includes a housing in which are disposed the first coil, the second coil, the plunger, the limit switch, the pair of load contacts and the arc extinguisher. In certain of these embodiments, the housing has formed therein at least one vent hole in order to allow gases and/or debris to be vented out of the housing. In some of these embodiments, the at least one vent hole comprises a plurality of vent holes positioned adjacent to the arc extinguisher.

In some embodiments, the first coil, the second coil and the limit switch are all mounted on a common circuit board. In some embodiments, the common contact of the limit switch is biased toward electrical connection to either the first coil contact or the second coil contact, but is moveable against the bias toward electrical connection with the other of the first coil contact or the second coil contact based on the position of the plunger.

In accordance with another aspect of the invention, a latching relay includes a housing, a first coil disposed in the housing, a second coil disposed in the housing and a common plunger operatively connected between the first coil and the second coil such that activation of the first coil moves the plunger in a first direction to a first position and activation of the second coil moves the plunger in a second direction, opposite to the first direction, to a second position. The latching relay also includes a limit switch disposed in the housing, the limit switch comprising a common contact, a first coil contact and a second coil contact, wherein a position of the common contact is alternately switched between electrical connection to either the first coil contact or the second coil contact based on a position of the plunger. The first coil contact is electrically connected to the first coil and the second coil contact is electrically connected to the second coil such that when electrical power is applied to the common contact, the electrical power is alternately applied to either the first coil or the second coil depending on the position of the common contact. A moveable load contact arm is operatively connected to the plunger, and a pair of load contacts are moveable between a closed position in which power is supplied to a load and an open position in which power to the load is interrupted, the pair of load contacts comprising a stationary load contact and a moveable load contact disposed on the moveable load contact arm. A linkage is operatively connected between the plunger, the moveable load contact arm and the limit switch, wherein movement of the plunger causes simultaneous movement of both the moveable contact arm and the common contact of the limit switch via the linkage.

Other features and advantages of the invention will become more apparent from consideration of the following drawings.

DETAILED DESCRIPTION OF THE INVENTION

Figure 1:
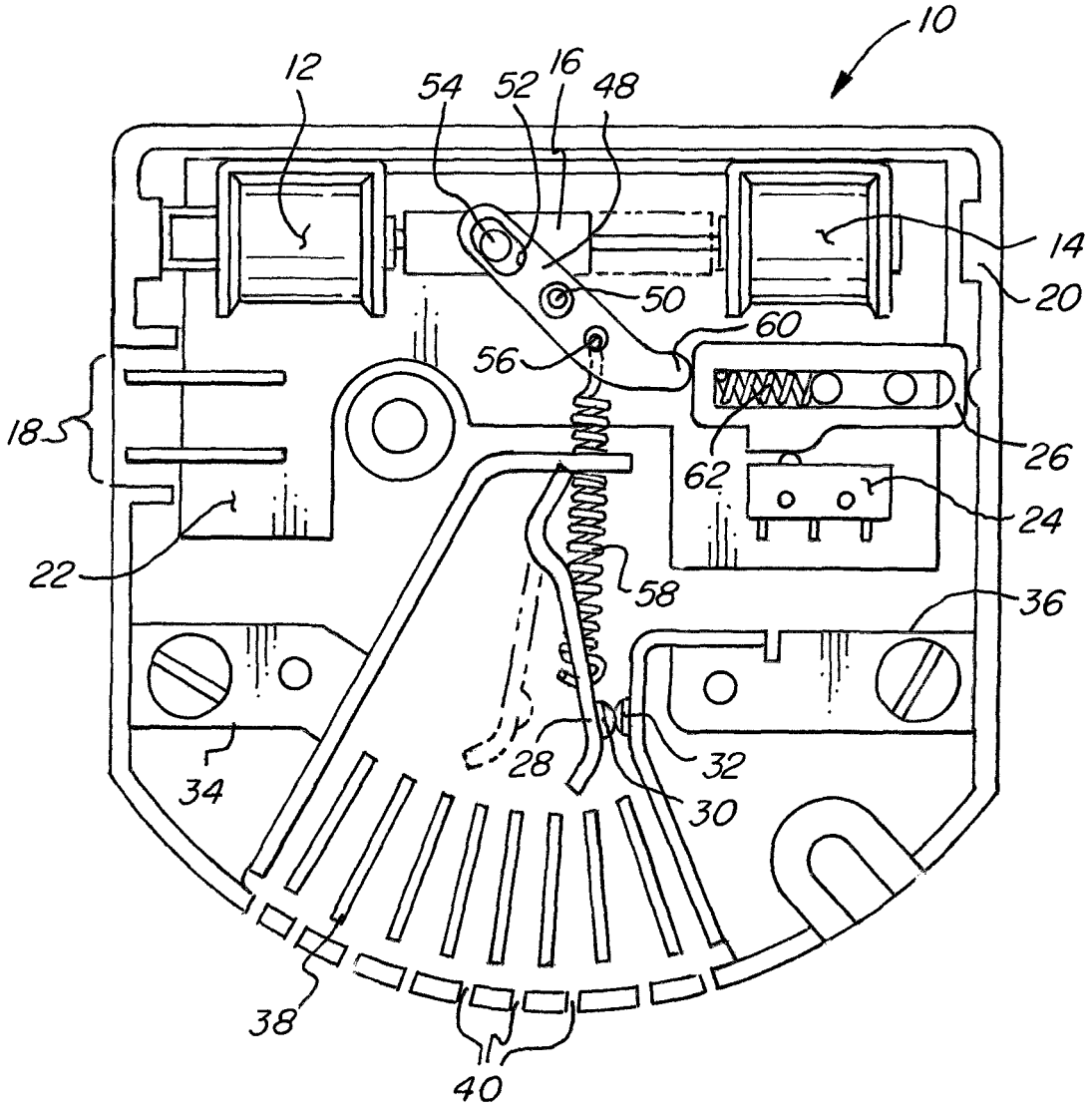
FIG. 1 is a side cut-away view of an exemplary configuration of the inventive latching relay.

FIG. 1 is an illustration of one exemplary configuration of a latching relay (10) in accordance with the present invention including a first coil (12), a second coil (14), and a common plunger (16) operatively connected between the first and second coils (12, 14). Relay coil terminals (18) are shown extending through a housing (20) for connection to a source of switched electrical power (not shown).

Both the first and second coils (12, 14) are shown positioned on a circuit board (22), which is in turn, positioned within the housing (20). A limit switch (24) is also shown positioned on the circuit board (22). A mechanical position indicator (26) is operatively connected between the plunger (16) and the limit switch (24), as is discussed more fully below.

A moveable contact arm (28), having a moveable contact (30) positioned on a distal end thereof, is vertically mounted in the latching relay housing (20) and is moveable between an open state (shown in dashed lines) and a closed state (shown in solid lines) relative to a stationary contact (32). Two load power terminals (34, 36) are shown, one to the left side of the housing (20) electrically connected to the moveable contact (30), and one to the right of the housing (20) electrically connected to the stationary contact (32).

An arc extinguisher in the form of a plurality of arc plates (38) is positioned at a bottom of the housing (20) and is positioned adjacent a path of travel of the moveable contact arm (28) when opening and closing. The arc extinguisher is adapted to facilitate quenching of an arc created between the load contacts (30, 32). Vent openings (40) are located in the bottom of the housing (20) adjacent to the arc plates (38) and along a path of travel of the moveable contact arm (28) such that gases and debris will be urged toward the vent openings (40) in order to facilitate the escape of such gases and debris.

Turning now to operation of the latching relay (10), the first coil (12), the second coil (14) and the common plunger (16) operatively connected therebetween are configured such that activation of the first coil (12) moves the plunger (16) in a first direction to a first position (i.e., toward the first coil (12)), as shown in solid lines in FIG. 1. On the other hand, activation of the second coil (14) moves the plunger (16) in a second direction, opposite to the first direction, to a second position (i.e., toward the second coil (14)), as shown in dashed lines in FIG. 1.

Figure 2:
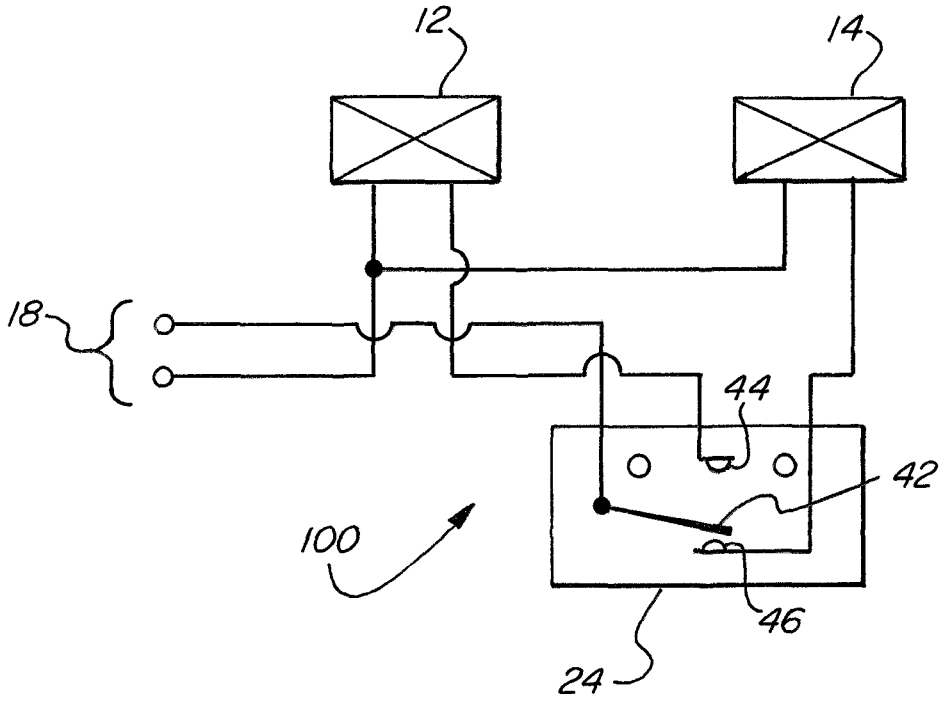
FIG. 2 is a schematic diagram of the latching relay circuit of FIG. 1 illustrating the electrical interconnections between the first and second coils and the limit switch.

Turning now to FIG. 2, a schematic diagram of the latching relay circuit (100) is shown. As shown, the limit switch (24) has a common contact (42), a first coil contact (44) and a second coil contact (46). A position of the common contact (42) is alternately switched between electrical connection to either the first coil contact (44) or the second coil contact (46) based on a position of the plunger (16), as more fully discussed below. The first coil contact (44) is electrically connected to the first coil (12) and the second coil contact (46) is electrically connected to the second coil (14) such that when electrical power is applied to the common contact (42) via the coil terminals (48), the electrical power is alternately applied to either the first coil (12) or the second coil (14) depending on the position of the common contact (42).

For example, with the common contact (42) in the position indicated in FIG. 2, upon application of electrical power to the coil terminals (18), power would be applied to the second coil (14), which in turn, would cause the plunger (16) to be drawn toward the second coil (14) and open the load contacts (30, 32). This would also function to change the contact connections within the limit switch (24) as will now be explained.

Turning again to FIG. 1, the latching relay (10) further includes a linkage (48) operatively connected between the plunger (16), the moveable load contact arm (28) and the limit switch (24), such that movement of the plunger (16) causes simultaneous movement of both the moveable contact arm (28) and the common contact (42) of the limit switch (24) via the linkage (48).

More specifically, the linkage (48) is shown to be pivotable about a pivot point (50). One end of linkage (48) is provided with a slot (52) that slideably engages a pin (54) disposed on the plunger (16) in order to allow translation of the sliding movement of the plunger (16) into pivoting movement of the linkage (48).

On an opposite side of the pivot point (50) is a pin (56) or the like to which is connected a spring (58). The other end of the spring (58) is connected to the moveable load contact arm (28). Thus, as the plunger (16) slides in one direction or the other, the linkage (48) pivots, thereby stretching the spring (58). When a certain point is reached, the force of the stretched spring (58) causes a rapid movement of the moveable load contact arm (28) to cause a rapid opening or closing of the load contacts (30, 32). The force of the spring (58) also ensures that the load contacts (30, 32) remain in contact when in the closed position.

As can also be seen, an end (60) of the linkage (48) is in contact with the mechanical position indicator (26) that is, in turn, operatively connected to the limit switch (24). The mechanical position indicator (26) may include a spring (62) or the like biasing the mechanical position indicator (26) toward the left, with respect to the orientation shown in FIG. 1. However, as shown, the mechanical position indicator (26) may be forced to move against the bias (i.e., to the right) by contact with the end (60) of the linkage (48) as shown in FIG. 1.

As will be recognized by those skilled in the art, when the mechanical position indicator (26) is positioned to the right (as shown in FIG. 1), the common contact (42) is in electrical communication with the second coil contact (46) (as shown in FIG. 2), whereas when the mechanical position indicator (26) is positioned to the left, the common contact (42) is in electrical communication with the first coil contact (44).

Thus, starting from the positions of components shown in solid lines in FIGS. 1 and 2 (i.e., with the load contacts (30, 32) closed such that the load would be receiving high voltage electrical power), upon application of electrical power to the coil terminals (18), power would be applied to the second coil (14), which in turn, would cause the plunger (16) to be drawn toward the second coil (14) and open the load contacts (30, 32). This would simultaneously cause the mechanical position indicator (26) to move to the left, thereby causing the common contact (42) of the limit switch (24) to move into electrical communication with the first coil contact (44).

Thus, the next time power is applied to the coil terminals (18), the electrical power would be applied to the first coil (12), which would function to pull the plunger (16) toward the first coil (12) and close the high voltage contacts (30, 32). This would also function to change the contact connections in the limit switch (24) to return to the position shown in FIG. 2.

In this manner, the latching relay (10) will change state upon the application of electrical power to the coil terminals (18), but will not change state until electrical power is again applied to the coil terminals (18).

This configuration requires the application of electrical power to drive the plunger from one coil to the other coil. This driving force provides the needed power to open the high voltage contacts even when under load. In other words, the driving of the plunger between a first and a second state allows for high current interrupting capacity.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A latching relay comprising:

a first coil;

a second coil;

a common plunger operatively connected between said first coil and said second coil such that activation of said first coil moves said plunger in a first direction to a first position and activation of said second coil moves said plunger in a second direction, opposite to the first direction, to a second position;

a pair of load contacts moveable between a closed position in which power is supplied to a load and an open position in which power to the load is interrupted;

a limit switch comprising a common contact, a first coil contact and a second coil contact, wherein a position of said common contact is alternately switched between electrical connection to either the first coil contact or the second coil contact based on a position of said plunger;

said first coil contact being electrically connected to said first coil and said second coil contact being electrically connected to said second coil such that when electrical power is applied to the common contact, the electrical power is alternately applied to either the first coil or the second coil depending on the position of the common contact; and wherein the load contacts are in the closed position when the plunger is in its first position and wherein the load contacts are in the open position when the plunger is in its second position.

2. The latching relay of claim 1 wherein the pair of load contacts comprises a stationary load contact and a moveable load contact.

3. The latching relay of claim 2 further comprising a moveable load contact arm operatively connected to said plunger, and wherein the moveable load contact is disposed on the moveable load contact arm.

4. The latching relay of claim 1 further comprising an arc extinguisher positioned adjacent the pair of load contacts, the arc extinguisher adapted to facilitate quenching of an arc created between the pair of load contacts.

5. The latching relay of claim 4 wherein the arc extinguisher comprises a plurality of arc quenching plates.

6. The latching relay of claim 1 wherein the common contact of said limit switch is biased toward electrical connection to either the first coil contact or the second coil contact, but is moveable against the bias toward electrical connection with the other of the first coil contact or the second coil contact based on the position of said plunger.

7. A latching relay comprising:

a first coil;

a second coil;

a common plunger operatively connected between said first coil and said second coil such that activation of said first coil moves said plunger in a first direction to a first position and activation of said second coil moves said plunger in a second direction, opposite to the first direction, to a second position;

a pair of load contacts moveable between a closed position in which power is supplied to a load and an open position in which power to the load is interrupted, wherein the pair of load contacts comprises a stationary load contact and a moveable load contact;

a limit switch comprising a common contact, a first coil contact and a second coil contact, wherein a position of said common contact is alternately switched between electrical connection to either the first coil contact or the second coil contact based on a position of said plunger;

said first coil contact being electrically connected to said first coil and said second coil contact being electrically connected to said second coil such that when electrical power is applied to the common contact, the electrical power is alternately applied to either the first coil or the second coil depending on the position of the common contact;

a moveable load contact arm operatively connected to said plunger, and wherein the moveable load contact is disposed on the moveable load contact arm; and a linkage operatively connected between the plunger, the moveable load contact arm and the limit switch, wherein movement of the plunger causes simultaneous movement of both the moveable contact arm and the common contact of the limit switch via the linkage.

8. A latching relay comprising:

a first coil;

a second coil;

a common plunger operatively connected between said first coil and said second coil such that activation of said first coil moves said plunger in a first direction to a first position and activation of said second coil moves said plunger in a second direction, opposite to the first direction, to a second position;

a pair of load contacts moveable between a closed position in which power is supplied to a load and an open position in which power to the load is interrupted;

a limit switch comprising a common contact, a first coil contact and a second coil contact, wherein a position of said common contact is alternately switched between electrical connection to either the first coil contact or the second coil contact based on a position of said plunger;

said first coil contact being electrically connected to said first coil and said second coil contact being electrically connected to said second coil such that when electrical power is applied to the common contact, the electrical power is alternately applied to either the first coil or the second coil depending on the position of the common contact;

an arc extinguisher positioned adjacent the pair of load contacts, the arc extinguisher adapted to facilitate quenching of an arc created between the pair of load contacts; and a housing in which are disposed said first coil, said second coil, said plunger, said limit switch, said pair of load contacts and said arc extinguisher.

9. The latching relay of claim 8 wherein said housing has formed therein at least one vent hole in order to allow gases and/or debris to be vented out of said housing.

10. The latching relay of claim 9 wherein the at least one vent hole comprises a plurality of vent holes positioned adjacent to the arc extinguisher.

11. A latching relay comprising:

a first coil;

a second coil;

a common plunger operatively connected between said first coil and said second coil such that activation of said first coil moves said plunger in a first direction to a first position and activation of said second coil moves said plunger in a second direction, opposite to the first direction, to a second position;

a limit switch comprising a common contact, a first coil contact and a second coil contact, wherein a position of said common contact is alternately switched between electrical connection to either the first coil contact or the second coil contact based on a position of said plunger;

said first coil contact being electrically connected to said first coil and said second coil contact being electrically connected to said second coil such that when electrical power is applied to the common contact, the electrical power is alternately applied to either the first coil or the second coil depending on the position of the common contact; and wherein said first coil, said second coil and said limit switch are all mounted on a common circuit board.

12. A latching relay comprising:

a housing;

a first coil disposed in said housing;

a second coil disposed in said housing;

a common plunger operatively connected between said first coil and said second coil such that activation of said first coil moves said plunger in a first direction to a first position and activation of said second coil moves said plunger in a second direction, opposite to the first direction, to a second position;

a limit switch disposed in said housing, said limit switch comprising a common contact, a first coil contact and a second coil contact, wherein a position of said common contact is alternately switched between electrical connection to either the first coil contact or the second coil contact based on a position of said plunger;

said first coil contact being electrically connected to said first coil and said second coil contact being electrically connected to said second coil such that when electrical power is applied to the common contact, the electrical power is alternately applied to either the first coil or the second coil depending on the position of the common contact;

a moveable load contact arm operatively connected to said plunger;

a pair of load contacts moveable between a closed position in which power is supplied to a load and an open position in which power to the load is interrupted, said pair of load contacts comprising a stationary load contact and a moveable load contact disposed on the moveable load contact arm; and a linkage operatively connected between the plunger, the moveable load contact arm and the limit switch, wherein movement of the plunger causes simultaneous movement of both the moveable contact arm and the common contact of the limit switch via the linkage.

13. The latching relay of claim 12 wherein the load contacts are in the closed position when the plunger is in its first position and wherein the load contacts are in the open position when the plunger is in its second position.

14. The latching relay of claim 12 further comprising an arc extinguisher positioned adjacent the pair of load contacts, the arc extinguisher adapted to facilitate quenching of an arc created between the pair of load contacts.

15. The latching relay of claim 14 wherein the arc extinguisher comprises a plurality of arc quenching plates.

16. The latching relay of claim 12 wherein said housing has formed therein at least one vent hole in order to allow gases and/or debris to be vented out of said housing.

17. The latching relay of claim 16 further comprising an arc extinguisher and wherein the at least one vent hole comprises a plurality of vent holes positioned adjacent to the arc extinguisher.

18. The latching relay of claim 12 wherein said first coil, said second coil and said limit switch are all mounted on a common circuit board.

19. The latching relay of claim 12 wherein the common contact of said limit switch is biased toward electrical connection to either the first coil contact or the second coil contact, but is moveable against the bias toward electrical connection with the other of the first coil contact or the second coil contact based on the position of said plunger.

* * * * *